US010135172B1

(12) United States Patent
Foltz et al.

(10) Patent No.: US 10,135,172 B1
(45) Date of Patent: Nov. 20, 2018

(54) CONNECTOR POSITION ASSURANCE MEMBER

(71) Applicant: TE CONNECTIVITY CORPORATION, Berwyn, PA (US)

(72) Inventors: Keith Richard Foltz, Duncannon, PA (US); Nicholas Lee Evans, Harrisburg, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/933,735

(22) Filed: Mar. 23, 2018

(51) Int. Cl.
*H01R 13/627* (2006.01)
*H01R 13/436* (2006.01)
*H01R 13/641* (2006.01)
*H01R 13/422* (2006.01)

(52) U.S. Cl.
CPC ..... *H01R 13/4368* (2013.01); *H01R 13/6272* (2013.01); *H01R 13/641* (2013.01); *H01R 13/4223* (2013.01)

(58) Field of Classification Search
CPC ..... H01R 13/7272; H01R 13/641
USPC ..... 439/352, 489
See application file for complete search history.

(56) References Cited

U.S. PATENT DOCUMENTS 4,634,204 A * 1/1987 Detter ..... H01R 13/641 439/347
5,624,271 A * 4/1997 Childs ..... H01R 13/6272 439/352
5,681,178 A * 10/1997 Kunkle ..... H01R 13/641 439/352
5,910,027 A * 6/1999 Wayt ..... H01R 13/641 439/352
6,234,826 B1 * 5/2001 Wilber ..... H01R 13/4368 439/352
6,439,915 B2 * 8/2002 Kurimoto ..... H01R 13/6272 439/352
6,780,045 B2 * 8/2004 Shuey ..... H01R 13/6272 439/352
6,939,159 B1 * 9/2005 Klein ..... H01R 13/6272 439/352
7,201,599 B2 * 4/2007 Holub ..... H01R 13/506 439/352
7,399,195 B2 * 7/2008 Kim ..... H01R 13/641 439/352
7,892,012 B1 * 2/2011 Foung ..... H01R 13/633 439/344
8,348,686 B1 * 1/2013 Huang ..... H01R 13/6392 439/133

(Continued)

*Primary Examiner* — Neil Abrams

(57) ABSTRACT

A connector position assurance device having a base portion and a pair of resiliently deformable beams. Cam engaging members extend from side walls of the pair of resiliently deformable beams. A first lockout projection engagement member is provided proximate the beam front ends of the pair of resiliently deformable beams and extends between the first beam and the second beam. A second lockout projection engagement member is spaced from the base front end and spaced from the first lockout projection engagement member. The second lockout projection engagement member extends between the first beam and the second beam. A lockout projection receiving opening is formed by the first lockout projection engagement member, the second lockout projection engagement member, and portions of the pair of resiliently deformable beams.

20 Claims, 9 Drawing Sheets

(56) References Cited

U.S. PATENT DOCUMENTS

| | | | | |
|---|---|---|---|---|
| 8,920,187 | B2 * | 12/2014 | Kon | H01R 13/641<br>439/352 |
| 8,926,356 | B2 * | 1/2015 | Kon | H01R 13/6272<br>439/352 |
| 9,054,458 | B1 * | 6/2015 | Ng | H01R 13/641 |
| 9,893,467 | B2 * | 2/2018 | Chen | H01R 13/639 |
| 9,935,396 | B2 * | 4/2018 | Endo | H01R 13/6271 |
| 10,038,278 | B2 * | 7/2018 | Lane | H01R 13/6272 |

* cited by examiner

CONNECTOR POSITION ASSURANCE MEMBER

FIELD OF THE INVENTION

The present invention is directed to a connector position assurance device, an electrical connector and an electrical connector assembly which provides proper connector position assurance to assure that the mating connectors are properly mated. In particular, the connector position assurance device, the electrical connector and the electrical connector assembly provides proper connector position assurance for a connector assembly of small size.

BACKGROUND OF THE INVENTION

In certain applications, electronic components require an electrical connector assembly that joins first and second housings containing electrical contacts. One housing includes male electrical contacts, while the other housing includes female electrical contacts. The first housing is configured to be received inside the second housing such that the male and female electrical contacts are electrically connected. In order to be sure that the first and second housings are properly connected with the electrical contacts, the first and second housing are provided with a latch assembly more generally referred to as a position assurance feature. In known applications, the latch assembly includes a base plate, a suspended prong on the first housing and a ramp on the second housing. The base plate is slidably retained beside the prong. When the first housing is inserted about the second housing, the prong snaps over the ramp and the base plate is then slid over the ramp and the prong into an engagement position. In many applications, an audible click is typically used to detect if the connector is fully mated, however, noise at the assembly plant can make this ineffective.

Additionally, electrical connectors have been proposed that utilize a latch or retention assembly to maintain connector halves in a fully mated position, along with a connector position assurance (CPA) device. When the connector halves are mated and the latch or retention assembly is positioned to maintain contact between the connector halves, the connector position assurance device is moved to a position that indicates the connector halves are properly connected. Thus, the connector position assurance device provides a means to assure that the connector halves are fully mated.

Known connector position assurance devices require a significant space as compared to the first and second housings. Consequently, known connector position assurance devices are not practical with small connectors, as the connector size limits how the connector position assurance can interact with the housings. In addition, even when using known connector position assurances, a significant amount of connectors fail to mate properly. For example, the largest warranty problem with automotive connectors is that the connectors are not fully mated, causing system failures after the automobile has left the assembly plant. This is due to the fact that, at the vehicle assembly plant, some connectors are mated far enough to make initial, electrical contact but the latches of the connectors are not fully engaged, causing the connectors to not be locked or secured together. These connectors later come apart in the field, as the vehicle is driven on bumpy roads, etc. causing loss of system function. Even incorporating known connector position assurances into the connectors does not guarantee that the connectors will be properly mated and secured, as in many instances the operator does not properly activate the connector position assurances.

It would be beneficial to have a connector position assurance device which overcomes the problems identified above and which provides proper connector position assurance for a connector assembly of small size. It would also be beneficial to prevent or block the connector position assurance from its fully engaged position if the connector is partially mated or not mated at all.

SUMMARY OF THE INVENTION

An embodiment is directed to a connector position assurance device having a base portion and a pair of resiliently deformable beams. The base portion has a top surface, a bottom surface, a base front end and a base back end. The pair of resiliently deformable beams extends from the base front end in a direction away from the base back end, with the beams having beam front ends spaced from the base portion. A first cam engaging member extends from a side wall of a first beam of the pair of resiliently deformable beams in a direction away from a second beam of the pair of resiliently deformable beams. A second cam engaging member extends from a side wall of the second beam of the pair of resiliently deformable beams in a direction away from the first beam of the pair of resiliently deformable beams. A first lockout projection engagement member is provided proximate the beam front ends of the pair of resiliently deformable beams and extends between the first beam and the second beam. A second lockout projection engagement member is spaced from the base front end and spaced from the first lockout projection engagement member. The second lockout projection engagement member extends between the first beam and the second beam. A lockout projection receiving opening is formed by the first lockout projection engagement member, the second lockout projection engagement member, and portions of the pair of resiliently deformable beams. The connector position assurance device is maintained in an initial position on a connector until the first cam engaging member and the second cam engaging member engage cam members of the mating connector to allow a lockout projection of the mating connector to be positioned in the lockout projection receiving opening.

An embodiment is directed to a connector having a connector position assurance device. The connector includes a latch which extends from a housing of the connector; a connector position assurance receiving opening positioned proximate the latch; and a lockout projection provided in the housing. The connector position assurance device is positioned in the connector position assurance receiving opening. The connector position assurance device includes a pair of resiliently deformable beams. A first cam engaging member extends from a side wall of a first beam of the pair of resiliently deformable beams in a direction away from a second beam of the pair of resiliently deformable beams. A second cam engaging member extends from a side wall of the second beam of the pair of resiliently deformable beams in a direction away from the first beam of the pair of resiliently deformable beams. A first lockout projection engagement member extends between the first beam and the second beam. A second lockout projection engagement member is spaced from the first lockout projection engagement member and extends between the first beam and the second beam. A lockout projection receiving opening is formed by the first lockout projection engagement member, the second lockout projection engagement member and portions of the pair of resiliently deformable beams. The connector position assurance device is maintained in an initial position in the connector position assurance receiving opening until the first cam engaging member and the second cam engaging member engage cam members of the mating connector to allow the lockout projection of the mating connector to be positioned in the lockout projection receiving opening.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
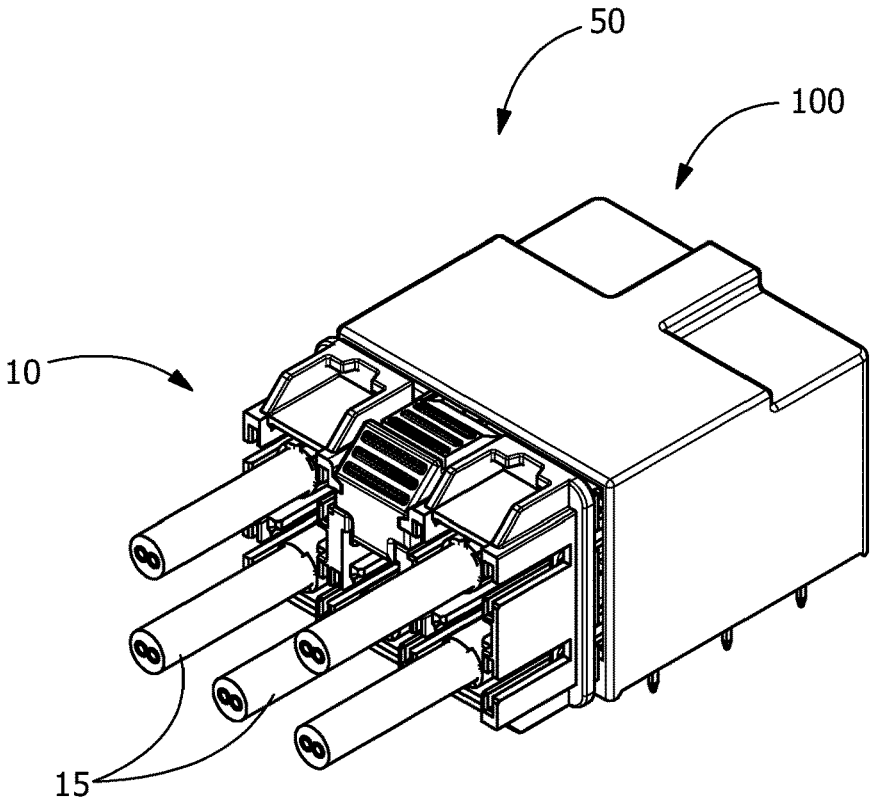
FIG. 1 is a perspective view of an illustrative plug connector mated with an illustrative header or mating connector.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features, the scope of the invention being defined by the claims appended hereto.

FIG. 1 shows a perspective view of an electrical connector or plug 10 mated with a mating connector or header 100 which together form a connector assembly 50. The electrical connector 10 and mating connector 100 are shown as representations and may vary without departing from the scope of the invention. The connectors 10 and 100 will have many other features, such as contacts and contact latches, which are not shown in the figures.

Figure 2:
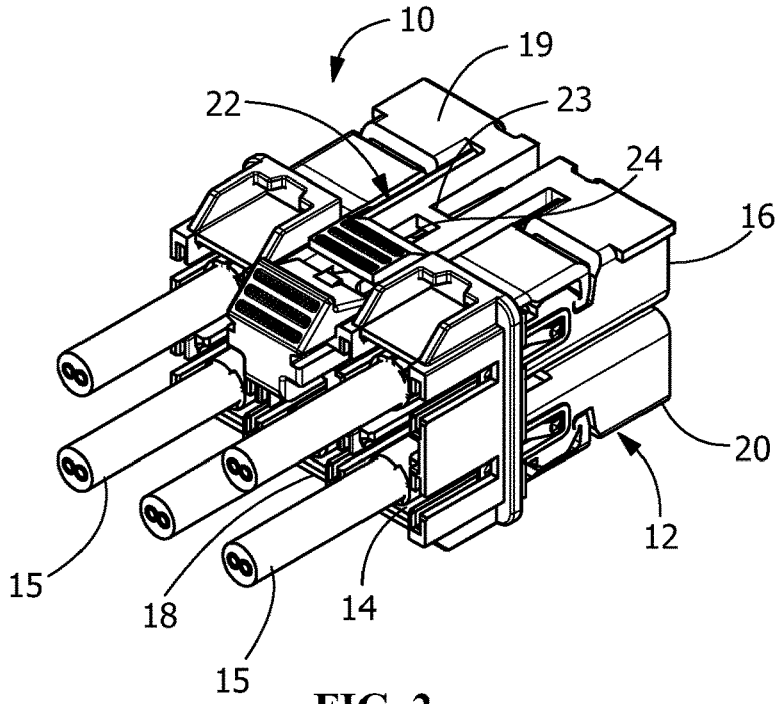
FIG. 2 is a top perspective view of the plug connector of FIG. 1.
Figure 6A:
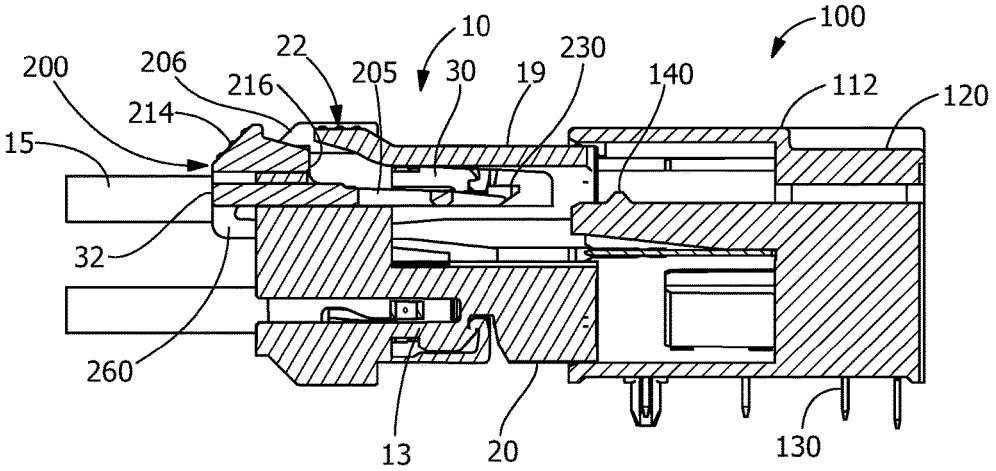
FIG. 6A is a cross-sectional view taken through a beam of the connector position assurance member showing the plug connector initially engaging the header or mating connector, with the connector position assurance member in an initial position.

Referring to FIG. 2, the electrical connector 10 has a housing body 12 with contact receiving passages 14 for receiving contacts 13 therein (FIG. 6A). The electrical connector 10 has a forward mating end 16 and a rearward end 18. Conductors or wires 15, which are in electrical engagement with the contacts 13 inserted in the passages 14, extend from the rearward end 18. A first or top surface 19 and an oppositely facing second or bottom surface 20 extend between the mating end 16 and the rearward end 18.

A latch or latch arm 22 having an engagement surface 23 and a latching opening 24 extends from the top surface 19. In the embodiment shown, the latch 22 is connected to the top surface 19 proximate the forward mating end 16 and extends toward the rearward end 18. The latch 22 is used to latch and secure the mating connector 100 to the connector 10, as will be more fully described below.

As shown in FIGS. 6 through 10, positioned proximate the latch arm 22 is a connector position assurance (CPA) receiving recess 30. A connector position assurance latch arm receiving opening 32 extends from the rearward end 18 toward the mating end 16. The connector position assurance latch arm receiving opening 32 is positioned proximate to and below the connector position assurance receiving recess 30.

Figure 3:
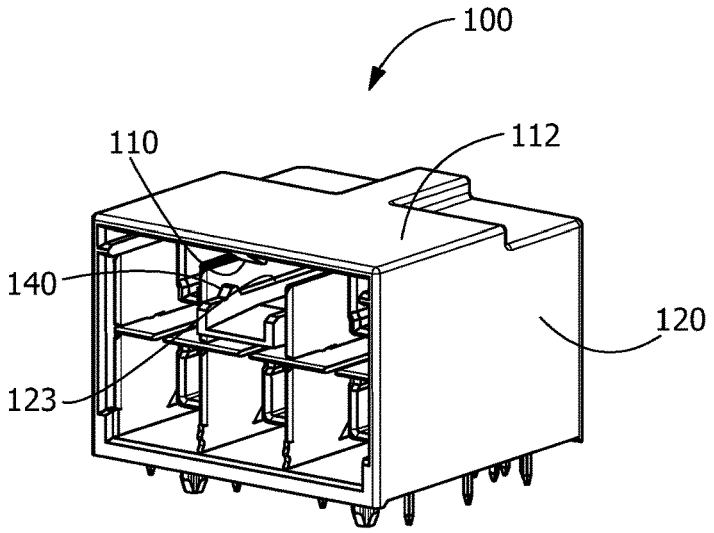
FIG. 3 is a front perspective view of the header or mating connector of FIG. 1.

As best shown in FIG. 3, the mating connector 100 has a complimentary latching protrusion 110 which is positioned to engage the latch arm 22 as the connector 10 and the mating connector are moved from an unmated position to a mated position. In the embodiment shown, the latching protrusion 110 extends downward from a top surface 112 of a shroud 120 of the mating connector 100.

When properly mated together, the latching protrusion 110 cooperates with and is positioned in the latching opening 24 to secure the mating connector 100 with the electrical connector 10. In the mated position, the connector 10 is received within the shroud 120 of the mating connector 100. Electrical contacts 130 (FIGS. 6A and 6B) of the mating connector 100 mate with electrical contacts 13 in the electrical connector 10.

Connector position assurance engagement ribs or activation projections 140 are provided on either side of the latching protrusion 110. The activation projections 140 are spaced from the latching protrusion 110 and extend from an interior surface 123 of the mating connector 100 which is spaced from and opposed to the top surface 112 of the shroud 120.

As shown in FIGS. 6 through 10, a connector position assurance device 200 is positioned proximate to and is movable relative to the latch arm 22 of the connector 10. The connector position assurance device 200 is maintained in the connector position assurance receiving opening 30 and is movable between a first position or open position, as shown in FIG. 6, and a second or fully inserted position, as shown in FIG. 10.

Figure 4:
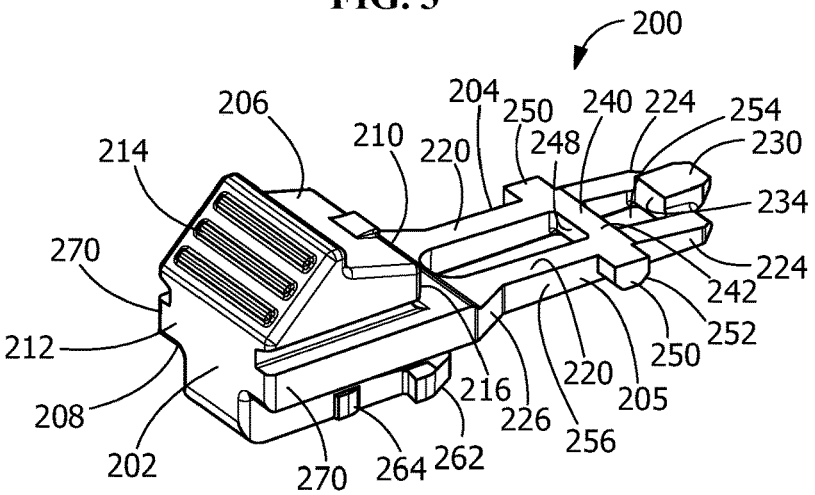
FIG. 4 is a top perspective view of an illustrative connector position assurance member housed in the plug connector.
Figure 5:
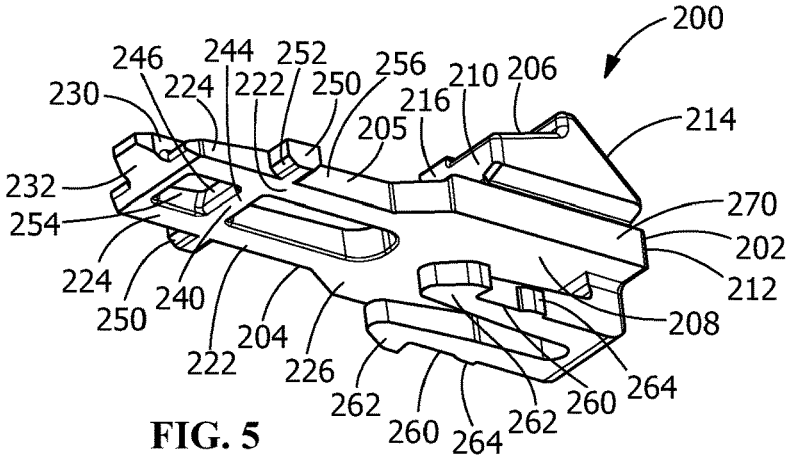
FIG. 5 is a bottom perspective view of the connector position assurance member of FIG. 4.

Referring to FIGS. 4 and 5, the connector position assurance device 200 has a base portion 202 and two essentially parallel resiliently deformable beams 204, 205 which extend from the base portion 202. The base portion 202 has a top surface 206, a bottom surface 208, a base front end 210 and a base back end 212. The beams 204 extend from the front end 210 in a direction away from the back end 212. The back end 212 of the base portion 202 includes an engagement section 214 to allow an operator to manually engage or activate the connector position assurance device 200, as will be more fully described. In the illustrative embodiment shown, operator engagement section 214 extends across essentially the entire width of the back end 212. However, other configurations may be used without departing from the scope of the invention. The front end 210 of the base portion 212 includes a latch engagement section 216 which extends from the top surface 206 of the base portion 202. As will be described further below, the latch engagement section 216 is configured to interact with the latch 22.

The resiliently deformable beams 204, 205 are generally rectangular in shape. Each beam 204, 205 has a top side 220, a bottom side 222, a beam front end 224 and a beam back end 226. The back end 226 of each beam 204, 205 is attached to or is integral with the front end 210 of the base portion 202.

A front projection or first lockout projection engagement member 230 extends between the front ends 224 of the beams 204, 205. The front projection or first lockout projection engagement member 230 extends from the bottom sides 222 of the beams 204, 205 to beyond the top sides 220. A lead-in surface 232 extends across the front ends of the beams 204, 205 and the first lockout projection engagement member 230. A back surface 234 of the first lockout projection engagement member 230 extends in a direction which is essentially perpendicular to the top sides 220 of the beams 204, 205.

A cross beam or second lockout projection engagement member 240 extends across the beams 204, 205. The cross beam or second lockout projection engagement member 240 is spaced between the front projection or first lockout projection engagement member 230 and the base portion 202. The longitudinal axis of the cross beam or second lockout projection engagement member 240 extends essentially perpendicular to the longitudinal axis of the beams 204, 205. The cross beam or second lockout projection engagement member 240 has a top side 242, a bottom side 244, a front side surface 246 and a back side surface 248. As best shown in FIG. 6, the portion of the front side surface 246 of the cross beam or second lockout projection engagement member 240 which extends between the beams 204, 205 is tapered such that the bottom side 244 of the second lockout projection engagement member 240 is wider than the top side 242 of the second lockout projection engagement member 240 in the area between the beams 204, 205.

Provided in-line with the cross beam or second lockout projection engagement member 240 are cam engagement members or activation nub engagement members 250. The cam engagement members or activation nub engagement members 250 extend from sidewalls 256 of each beam 204, 205. The cam engagement members or activation nub engagement members 250 have sloped surfaces 252 to better cooperate with the activation projections 140, as will be more fully described.

A lockout projection receiving opening 254 is provide between the front projection or first lockout projection engagement member 230 and the cross beams or second lockout projection engagement member 240 and between the beam 204 and the beam 205. The lockout projection receiving opening 254 is configured to receive a lockout projection of the connector 10 therein.

Resilient positioning arms 260 extend from the bottom surface 208 of the base portion 202. The resilient positioning arms 260 form a V-shaped member with the resilient positioning arms 260 forming the sides. The resilient positioning arms 260 have first latching projections 262 provided at the free ends. Second latching projections 264 are provided on the resilient positioning arms 260 and are spaced from the first latch projections 262. The resilient positioning arms 260 cooperate with the connector 10 to prevent the removal of the connector position assurance device 200 from the connector and to retain the connector position assurance device 200 in the first position on the connector 10 prior to mating with the mating connector 100.

Rail projections 270 extend from sidewalls of the base portion 202. The rail projections 270 extend from the front end 210 of the base portion 202 to the back end 212. The longitudinal axis of the rail portions 270 is essentially parallel to and in-line with the longitudinal axis of the beams 204, 205. The rail projections 270 cooperate with rail receiving recesses of the connector 10 to keep the connector position assurance device 200 tightly controlled and aligned up-and-down within the housing body 12 of the connector 10. This accurate alignment of the connector position assurance device 200 in the connector 10 ensures that the first lockout projection engagement member 230 and the second lockout projection engagement member 240 of the connector position assurance device 200 are properly aligned with the locking nub or projection 40 of the connector 10. In addition, the accurate alignment of the connector position assurance device 200 in the connector 10 ensures that the cam engagement members or activation nub engagement members 250 of the connector position assurance device 200 are properly aligned with the connector position assurance engagement ribs or activation projections 140 of the mating connector 100.

Referring to FIGS. 6 through 10, the progression or method of inserting the plug or connector 10 into the header or mating connector 100 is shown.

Figure 6B:
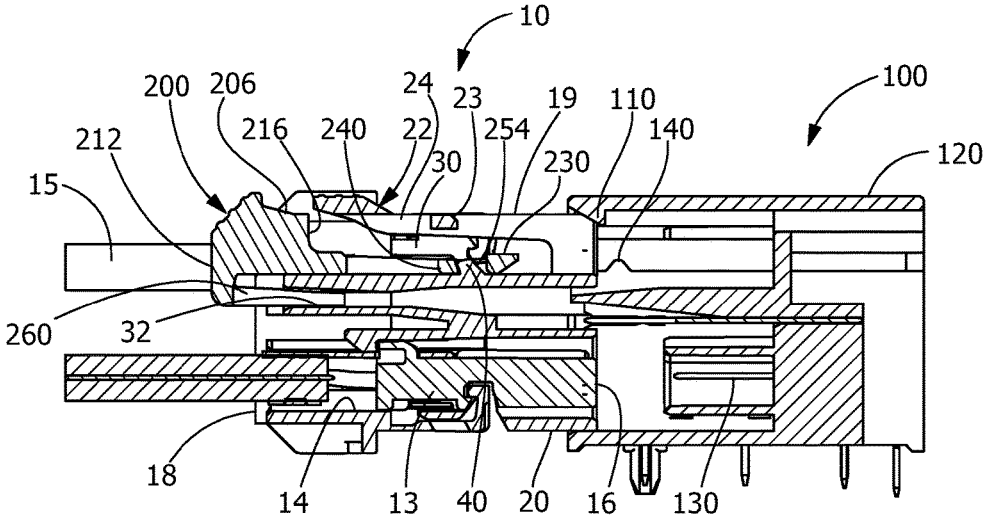
FIG. 6B is a cross-sectional view taken through a latching projection of the plug connector showing the plug connector initially engaging the header or mating connector, with the connector position assurance member in the initial position.
Figure 6C:
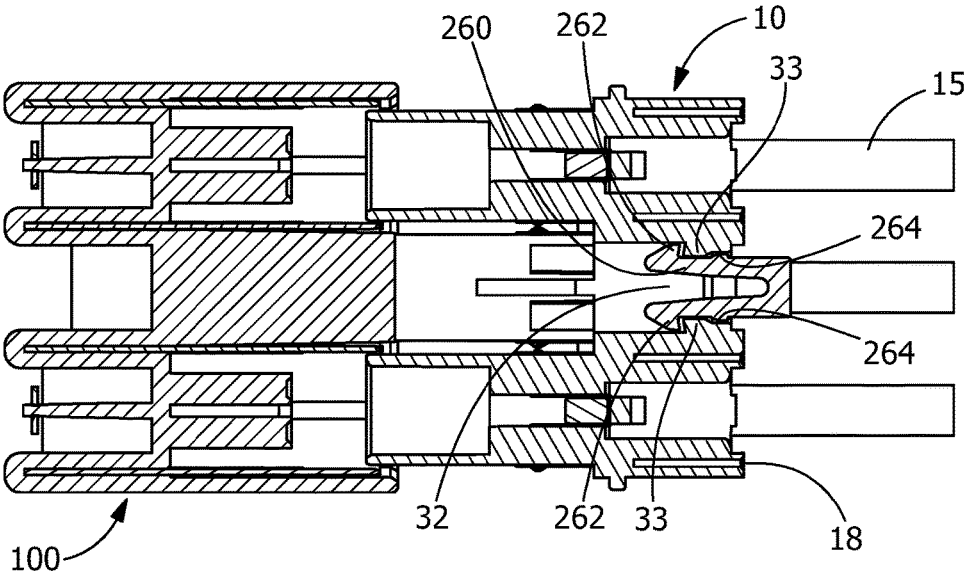
FIG. 6*c* is a cross-sectional view taken through positioning arms of the plug connector showing the connector position assurance member in the initial position.

In FIGS. 6A and 6B, the connector 10 is shown loosely positioned in the header connector 100. In this position, the latching protrusion 110 has not engaged the latch 22. The connector position assurance device 200 is maintained in the pre-mated, open or first position. In this position, the latch 22 is in a normal or undeflected position. As best shown in FIG. 6C, the connector position assurance device 200 is maintained in the pre-mated, open or first position by the cooperation of the first latching projections 262 and the second latching projections 264 of the resilient positioning arms 260 with projections 33 which extend into connector position assurance latch arm receiving opening 32. In addition, as best shown in FIG. 6B, a locking nub or projection 40 of the connector 10 is positioned in the lockout projection receiving opening 254, between the first lockout projection engagement member 230 and the second lockout projection engagement member 240.

Figure 7A:
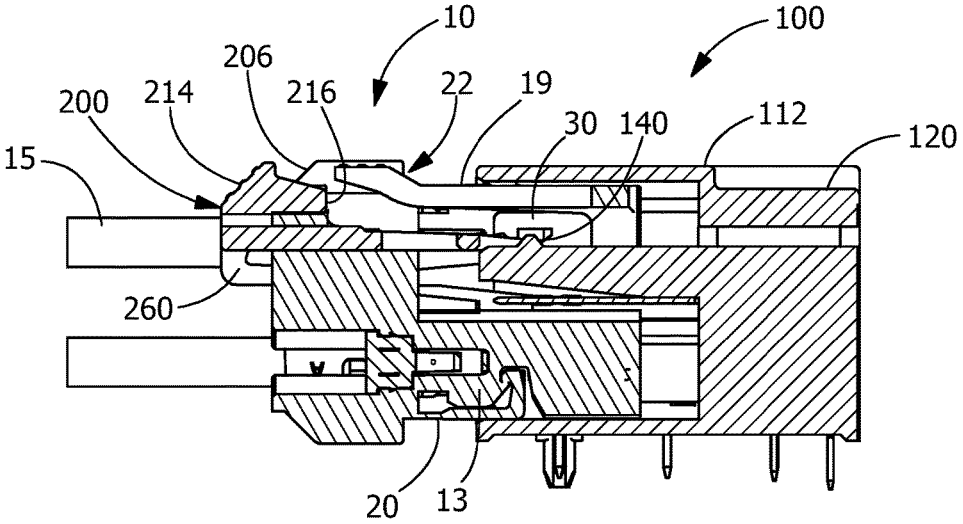
FIG. 7A is a cross-sectional view taken through the beam of the connector position assurance member showing the plug connector partially mated to the header or mating connector, with the connector position assurance member in the initial position.
Figure 7B:
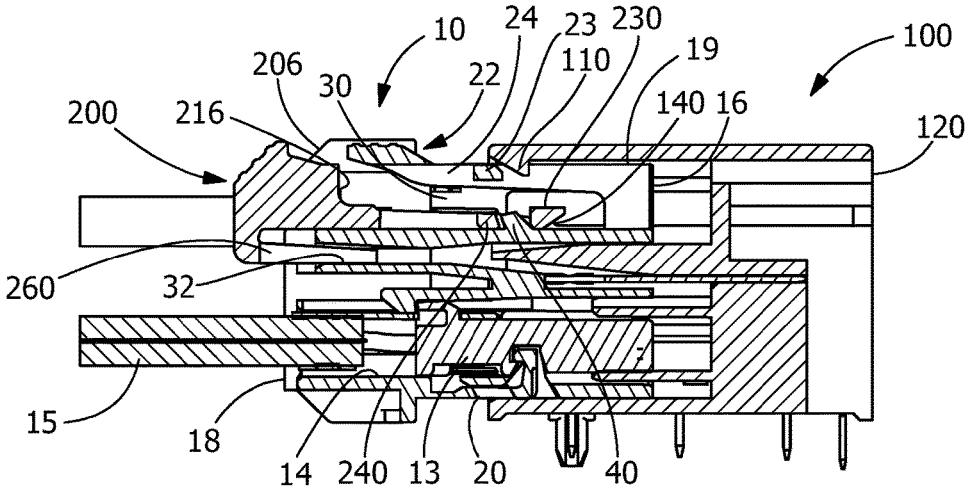
FIG. 7B is a cross-sectional view taken through the latching projection of the plug connector showing the plug connector partially mated to the header or mating connector, with the connector position assurance member in the initial position.
Figure 8A:
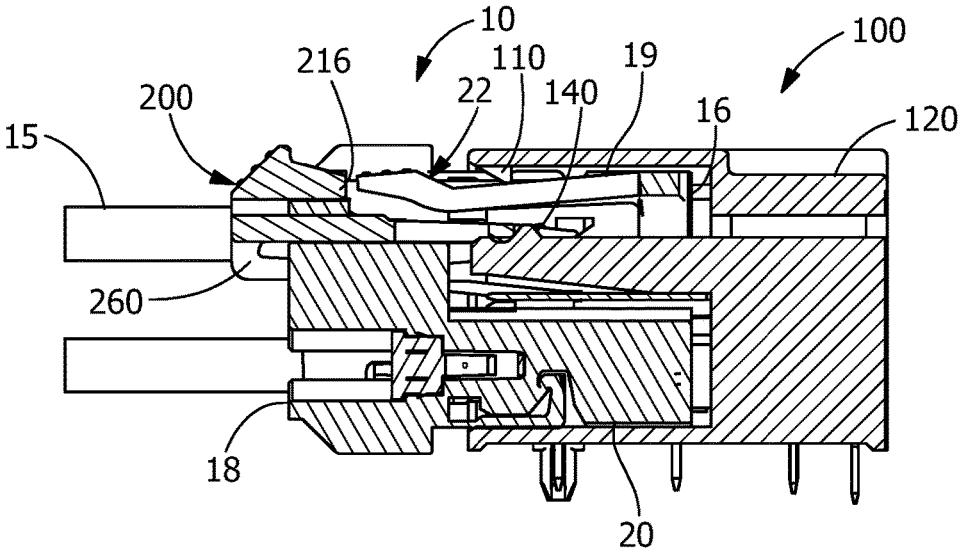
FIG. 8A is a cross-sectional view taken through the beam of the connector position assurance member showing the plug connector more fully mated to the header or mating connector than shown in FIG. 7A, with the connector position assurance member in the initial position.
Figure 8B:
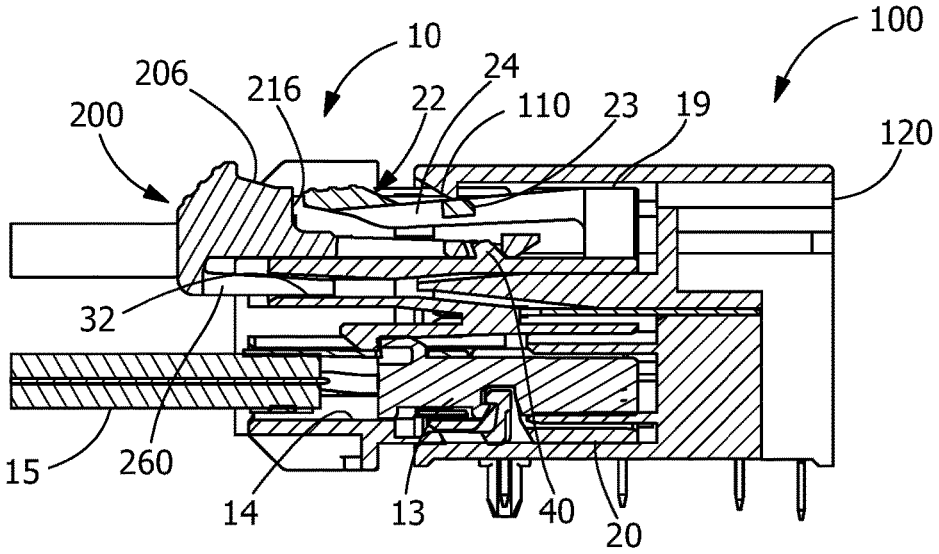
FIG. 8B is a cross-sectional view taken through the latching projection of the plug connector showing the plug connector more fully mated to the header or mating connector than shown in FIG. 7B, with the connector position assurance member in the initial position.

As the connector 10 is partially inserted into the shroud 120 of the mating connector 100, as shown in FIGS. 7A and 7B, the engagement surface 23 of the latch 22 is moved into engagement with the latching protrusion 110 of the mating connector 100. As insertion continues, the latching protrusion 110 causes the engagement surface 23 and the latch 22 to be resiliently activated or deflected away from the top surface 19 of the connector 10 toward the bottom surface 20 of the connector 10, as shown in FIGS. 8A and 8B. If the connector 10 cannot properly mate with the mating connector 100, for example due to improper alignment of the contacts 13, 130, the continued insertion of the connector 10 into the mating connector 100 may be prevented. If this occurs, the latch 22 will remain in the deflected position shown in FIGS. 8A and 8B. In this position, the connector position assurance device 200 cannot be moved to a second or inserted position, as the latch 22 will engage the latch engagement section 216 of the connector position assurance device 200 to prevent the movement of the connector position assurance device 200 to the mated, second or inserted position.

Figure 9A:
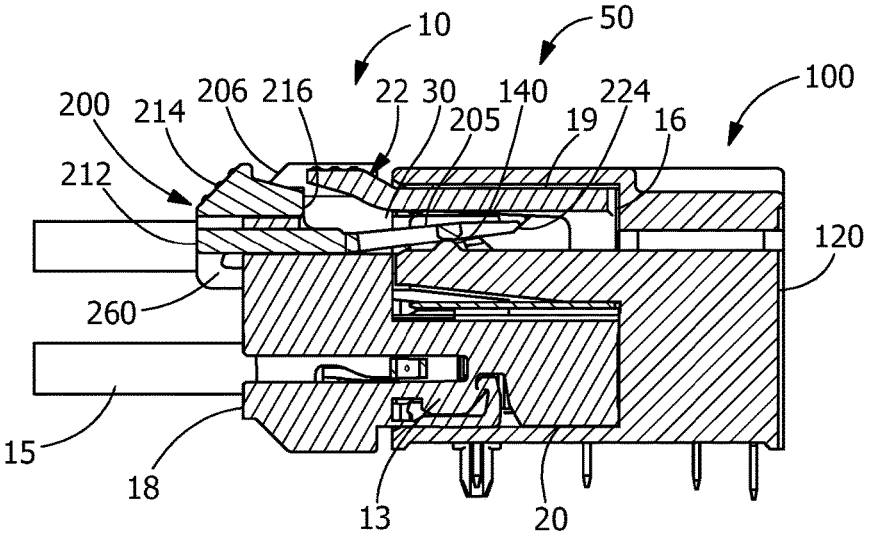
FIG. 9A is a cross-sectional view taken through the beam of the connector position assurance member showing the plug connector fully mated to the header or mating connector, with the connector position assurance member between the initial position and a final or locked position.
Figure 9B:
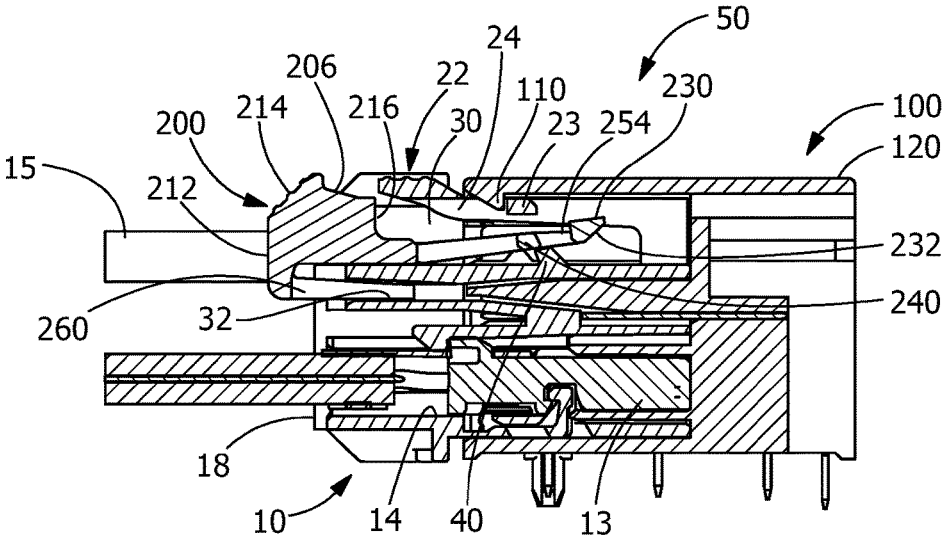
FIG. 9B is a cross-sectional view taken through the latching projection of the plug connector showing the plug connector fully mated to the header or mating connector, with the connector position assurance member between the initial position and the final or locked position.

As insertion continues, as shown in FIGS. 9A and 9B, the latch 22 is moved past the latching protrusion 110, allowing the latch 22 to return to its original or unstressed position. In this position, the latching protrusion 110 is positioned and retained in the latching opening 24. With the latching protrusion 110 properly positioned in the latching opening 24 of the latch 22, the connector position assurance device 200 can be moved from the pre-mated, open or first position toward the mated, second or inserted position. As this occurs, the cam engagement members or activation nub engagement members 250 engage the connector position assurance engagement projections 140 of the mating connector 100, forcing the cam engagement members or activation nub engagement members 250 and the resiliently deformable beams 204, 205 to move toward the top surface of the connector 10. As this occurs, the second lockout projection engagement member 240 is moved above the lockout nub or projection 40 of the connector, thereby allowing the continued insertion of the connector position assurance device 200 into the connector 10 to continue. However, if the connector 10 and mating connector 100 are not fully mated, the cam engagement members or activation nub engagement members 250 will not engage the connector position assurance engagement projections 140, thereby preventing the movement of the resiliently deformable beams 204, 205 and the second lockout projection engagement member 240. Consequently, continued insertion of the connector position assurance device 200 will be prevented by the cooperation of the second lockout projection engagement member 240 with the lockout nub or projection 40.

Figure 10A:
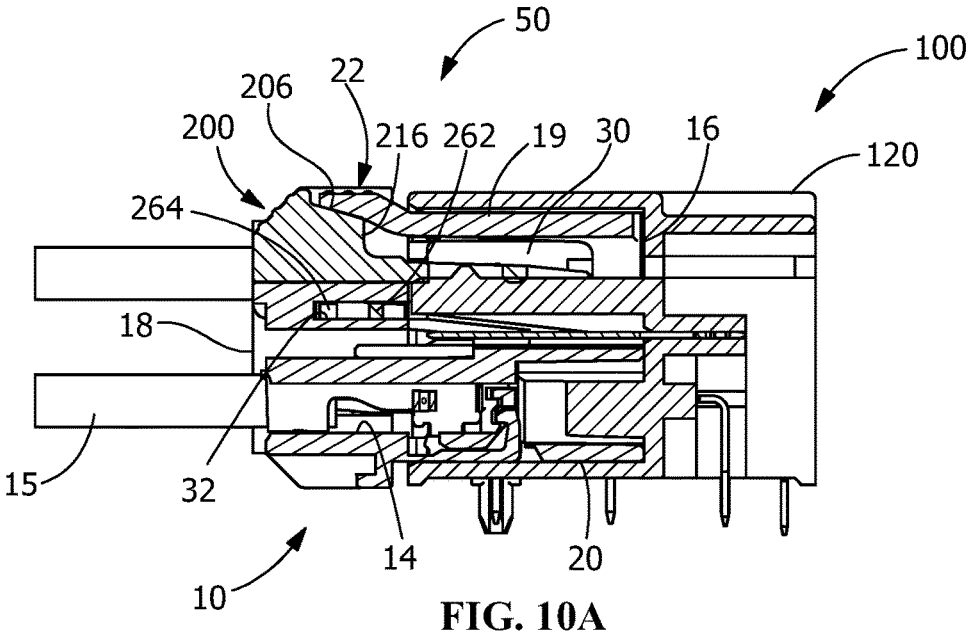
FIG. 10A is a cross-sectional view taken through the beam of the connector position assurance member showing the plug connector fully mated to the header or mating connector, with the connector position assurance member in the final or locked position.
Figure 10B:
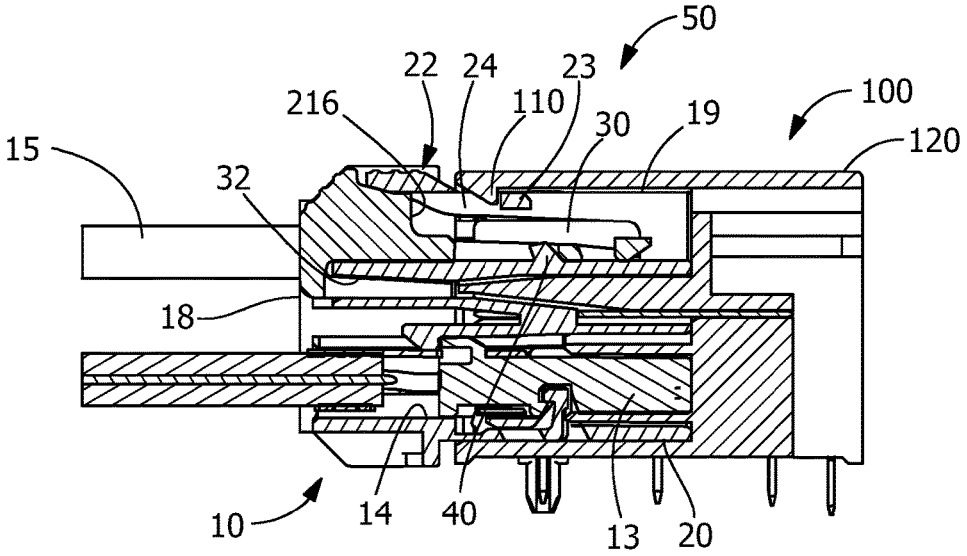
FIG. 10B is a cross-sectional view taken through the latching projection of the plug connector showing the plug connector fully mated to the header or mating connector, with the connector position assurance member in the final or locked position.
Figure 10C:
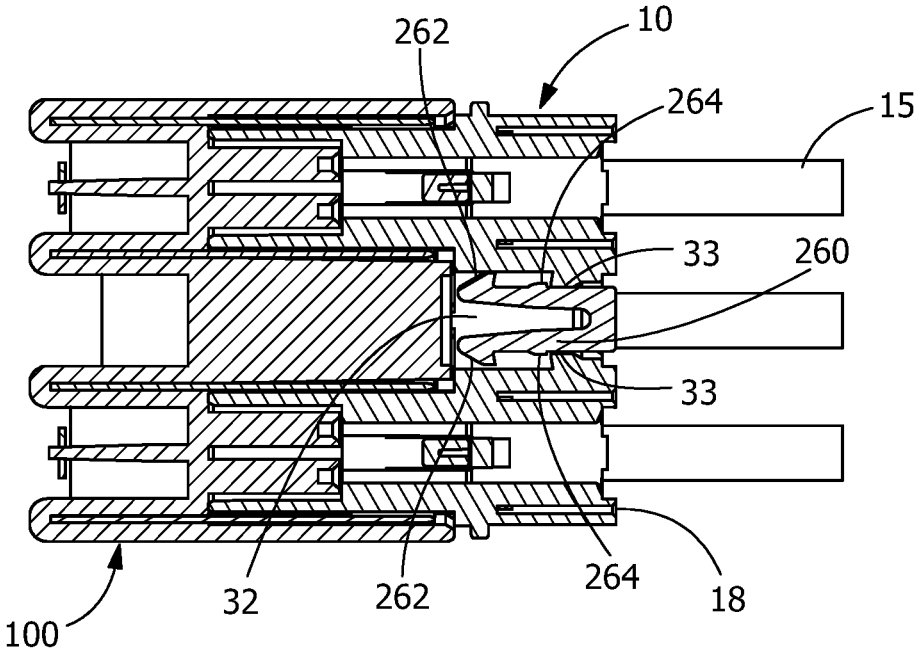
FIG. 10*c* is a cross-sectional view taken through positioning arms of the plug connector showing the plug connector fully mated to the header or mating connector, with the connector position assurance member in the final or locked position.

With the resiliently deformable beams 204, 205 properly deflected, the insertion of the connector position assurance device 200 can continue. As insertion continues, as shown in FIGS. 10A, 10B and 10C, the connector position assurance device 200 is moved to the mated, second or inserted position. In this position, the cam engagement members or activation nub engagement members 250 is moved beyond the connector position assurance engagement projections 140 of the mating connector 100, allowing the cam engagement members or activation nub engagement members 250 and the resiliently deformable beams 204, 205 to return toward an unstressed position. In this position, the second lockout projection engagement member 240 is moved past the lockout nub or projection 40 of the connector to the mated, closed or second position.

The connector position assurance device 200 is maintained in the mated, closed or second position by the cooperation of the second latching projections 264 of the resilient positioning arms 260 with the projections 33 which extend into connector position assurance latch arm receiving opening 32, as best shown in FIG. 10C.

In this fully inserted position, latch engagement protrusion 110 is positioned beneath latch 22, thereby preventing latch 22 from being moved downward. In this position, the top surface 206 of the connector position assurance device 200 blocks the activation or movement of the latch 22, which in turn prevents the unwanted or inadvertent unmating of the connector 10 from the mating connector 100.

If the connector 10 is to be unmated from the mating connector 100, the connector position assurance device 200 is returned to the initial position. As this occurs, a force is applied to the connector position assurance device 200 in the opposite direction of insertion, causing the cam engagement members or activation nub engagement members 250 to engage the connector position assurance engagement projections 140 of the mating connector 100, forcing the cam engagement members or activation nub engagement members 250 and the resiliently deformable beams 204, 205 to move toward the top surface of the connector 10. As this occurs, the second lockout projection engagement member 240 is moved above the lockout nub or projection 40 of the connector, thereby allowing the movement of the connector position assurance device 200 toward the pre-mated, open or first position. As the movement continues, the top surface 206 of the connector position assurance device 200 is moved away from the latch 22, allowing the latch 22 to be depressed, which in turn allows the connector 10 is to be unmated from the mating connector 100.

While the invention has been described with reference to a preferred embodiment, it will be understood by those skilled in the art that various changes may be made and equivalents may be substituted for elements thereof without departing from the spirit and scope of the invention as defined in the accompanying claims. In particular, it will be clear to those skilled in the art that the present invention may be embodied in other specific forms, structures, arrangements, proportions, sizes, and with other elements, materials and components, without departing from the spirit or essential characteristics thereof. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. A connector position assurance device comprising:
- a base portion having a top surface, a bottom surface, a base front end and a base back end;
- a pair of resiliently deformable beams extending from the base front end in a direction away from the base back end, the beams having beam front ends spaced from the base portion;
- a first cam engaging member extending from a side wall of a first beam of the pair of resiliently deformable beams in a direction away from a second beam of the pair of resiliently deformable beams;
- a second cam engaging member extending from a side wall of the second beam of the pair of resiliently deformable beams in a direction away from the first beam of the pair of resiliently deformable beams;
- a first lockout projection engagement member provided proximate the beam front ends of the pair of resiliently deformable beams and extending between the first beam and the second beam;
- a second lockout projection engagement member spaced from the base front end and spaced from the first lockout projection engagement member, the second lockout projection engagement member extending between the first beam and the second beam;
- a lockout projection receiving opening formed by the first lockout projection engagement member, the second lockout projection engagement member, and portions of the pair of resiliently deformable beams;
- wherein the connector position assurance device is maintained in an initial position on a connector until the first cam engaging member and the second cam engaging member engage cam members of the mating connector to allow a lockout projection of the mating connector to be positioned in the lockout projection receiving opening.

2. The connector position assurance device as recited in claim 1, wherein a latch engagement section is provided on the base front end and extends from the top surface of the base portion.

3. The connector position assurance device as recited in claim 1, wherein a lead-in surface extends across the beam front ends and the first lockout projection engagement member.

4. The connector position assurance device as recited in claim 3, wherein a back surface of the first lockout projection engagement member extends in a direction which is essentially perpendicular top sides of the beams.

5. The connector position assurance device as recited in claim 1, wherein a longitudinal axis of the second lockout projection engagement member extends essentially perpendicular to longitudinal axes of the beams.

6. The connector position assurance device as recited in claim 5, wherein a front side surface of the second lockout projection engagement member is tapered such that a bottom side of the second lockout projection engagement member is wider than a top side of the second lockout projection engagement member.

7. The connector position assurance device as recited in claim 1, wherein the first cam engagement members and the second cam engagement members have sloped surfaces.

8. The connector position assurance device as recited in claim 1, wherein resilient positioning arms extend from the bottom surface of the base portion.

9. The connector position assurance device as recited in claim 8, wherein the resilient positioning arms form a V-shaped member with the resilient positioning arms forming the sides.

10. The connector position assurance device as recited in claim 9, wherein the resilient positioning arms have first latching projections provided at free ends, second latching projections are provided on each resilient positioning arm and are spaced from the first latch projections, the resilient positioning arms prevent the removal of the connector position assurance device from a connector and retain the connector position assurance device in the initial position on the connector.

11. The connector position assurance device as recited in claim 1, wherein rail projections extend from sidewalls of the base portion, the rail projections extend from the base front end to the base back end.

12. The connector position assurance device as recited in claim 11, wherein longitudinal axes of the rail portions extend essentially parallel to and in-line with longitudinal axes of the beams.

13. A connector having a connector position assurance device, the connector comprising:
- a latch extending from a housing of the connector;
- a connector position assurance receiving opening positioned proximate the latch;
- a lockout projection provided in the housing;
- a connector position assurance device positioned in the connector position assurance receiving opening, the connector position assurance device comprising:
  - a pair of resiliently deformable beams;
  - a first cam engaging member extending from a side wall of a first beam of the pair of resiliently deformable beams in a direction away from a second beam of the pair of resiliently deformable beams;
  - a second cam engaging member extending from a side wall of the second beam of the pair of resiliently deformable beams in a direction away from the first beam of the pair of resiliently deformable beams;
  - a first lockout projection engagement member extending between the first beam and the second beam;
  - a second lockout projection engagement member spaced from the first lockout projection engagement member, the second lockout projection engagement member extending between the first beam and the second beam;

a lockout projection receiving opening formed by the first lockout projection engagement member, the second lockout projection engagement member, and portions of the pair of resiliently deformable beams;

wherein the connector position assurance device is maintained in an initial position in the connector position assurance receiving opening until the first cam engaging member and the second cam engaging member engage cam members of the mating connector to allow the lockout projection of the mating connector to be positioned in the lockout projection receiving opening.

14. The connector as recited in claim 13, wherein a latch engagement section is provided on the connector position assurance device and extends from the top surface of the connector position assurance device.

15. The connector as recited in claim 13, wherein a back surface of the first lockout projection engagement member extends in a direction which is essentially perpendicular to top sides of the pair of resiliently deformable beams.

16. The connector as recited in claim 13, wherein a longitudinal axis of the second lockout projection engagement member extends essentially perpendicular to longitudinal axes of the pair of resiliently deformable beams.

17. The connector as recited in claim 13, wherein a front side surface of the second lockout projection engagement member is tapered such that a bottom side of the second lockout projection engagement member is wider than a top side of the second lockout projection engagement member.

18. The connector as recited in claim 1, wherein the first cam engagement members and the second cam engagement members have sloped surfaces.

19. The connector as recited in claim 1, wherein resilient positioning arms extend from a bottom surface of the connector position assurance device.

20. The connector as recited in claim 19, wherein the resilient positioning arms have first latching projections provided at free ends, second latching projections are provided on each resilient positioning arm and are spaced from the first latch projections, the resilient positioning arms prevent the removal of the connector position assurance device from the connector and retain the connector position assurance device in the initial position on the connector.

* * * * *